US011635192B1

(12) United States Patent
Sanson

(10) Patent No.: US 11,635,192 B1
(45) Date of Patent: Apr. 25, 2023

(54) ADJUSTABLE UNDERWATER LIGHT FIXTURE ADAPTER

(71) Applicant: BELLSON ELECTRIC PTY LTD, Caringbah (AU)

(72) Inventor: David John Sanson, Taren Point (AU)

(73) Assignee: BELLSON ELECTRIC PTY LTD

( * ) Notice: Subject to any disclaimer, the term of this patent is extended or adjusted under 35 U.S.C. 154(b) by 0 days.

(21) Appl. No.: 17/562,343

(22) Filed: Dec. 27, 2021

(51) Int. Cl.
*F21V 21/14* (2006.01)
*F21V 17/12* (2006.01)
*F21W 131/401* (2006.01)
*F21V 21/04* (2006.01)

(52) U.S. Cl.
CPC ..... *F21V 21/14* (2013.01); *F21V 17/12* (2013.01); *F21V 21/047* (2013.01); *F21W 2131/401* (2013.01)

(58) Field of Classification Search
CPC ..... F21V 21/047; F21V 21/14; F21V 17/12; F21W 2131/401
See application file for complete search history.

(56) References Cited

U.S. PATENT DOCUMENTS 4,445,163 A 4/1984 Ziaylek, Jr. ..... F21V 17/06
4,574,337 A 3/1986 Poppenheimer ..... F21V 31/00
4,782,430 A 11/1988 Robbins et al. ..... F21V 7/04
4,829,410 A 5/1989 Patel ..... F21S 1/02
5,135,717 A 8/1992 Renzoni et al. ..... 422/61
5,301,096 A 4/1994 Klontz et al. ..... 363/37
5,404,297 A * 4/1995 Birk ..... B64D 11/00 362/372
5,494,793 A 2/1996 Schindele et al. ..... 435/6
5,649,760 A 7/1997 Beadle ..... F21S 1/00
5,908,236 A 6/1999 Lucken et al. ..... F21S 1/06
6,106,134 A 8/2000 Bomas ..... F21V 21/26
6,188,179 B1 2/2001 Boys et al. ..... 315/244
6,200,011 B1 3/2001 Miller et al. ..... F21V 8/00
6,301,128 B1 10/2001 Jang et al. ..... 363/17
6,371,628 B1 4/2002 Ward ..... F21V 21/14
(Continued)

FOREIGN PATENT DOCUMENTS

AU 2011338154 6/2016 ..... E04H 4/16
CN 105188230 12/2015 ..... H05B 37/02
(Continued)

OTHER PUBLICATIONS

U.S. Appl. No. 16/941,182, filed Jul. 28, 2020, Sanson et al.
(Continued)

*Primary Examiner* — Tsion Tumebo
(74) *Attorney, Agent, or Firm* — Hayes Soloway P.C.

(57) ABSTRACT

An underwater light fixture adapter system includes a lighting unit having a housing with at least one light positioned within the housing. An adapter has a substantially cylindrical shape with an open interior portion, wherein at least a portion of the housing is positionable within the open interior portion. A connection system is formed between the adapter and the housing of the lighting unit, wherein the connection system secures the housing to the adapter. At least one pivot contact is formed on an exterior surface of the adapter, the at least one pivot contact having a curved surface, wherein the curved surface is contactable to an inner wall of a niche to allow the housing and adapter to pivot.

20 Claims, 11 Drawing Sheets

(56) References Cited

U.S. PATENT DOCUMENTS

| | | | | |
|---|---|---|---|---|
| 6,459,218 | B2 | 10/2002 | Boys et al. | 315/324 |
| 6,568,823 | B1 | 5/2003 | Fielding et al. | F21V 33/00 |
| 6,719,438 | B2 | 4/2004 | Sevack et al. | F21V 17/00 |
| 6,825,620 | B2 | 11/2004 | Kuennen et al. | 315/224 |
| 7,011,439 | B1 * | 3/2006 | Kane | G02B 6/0008 362/269 |
| 7,125,146 | B2 | 10/2006 | Willis et al. | 362/267 |
| 7,178,178 | B2 | 2/2007 | Hutchings | 4/496 |
| 7,178,941 | B2 | 2/2007 | Roberge et al. | 362/225 |
| 7,180,248 | B2 | 2/2007 | Kuennen et al. | 315/224 |
| 7,182,484 | B2 | 2/2007 | Buelow, II et al. | 362/294 |
| 7,722,216 | B2 | 5/2010 | Amor et al. | F21V 17/00 |
| 8,030,851 | B2 | 10/2011 | Vemondier et al. | 315/149 |
| 8,152,334 | B2 * | 4/2012 | Krogman | F21V 15/01 362/249.02 |
| RE43,492 | E | 6/2012 | Willis et al. | 362/267 |
| 8,353,608 | B2 * | 1/2013 | Someno | G11B 7/125 403/56 |
| 8,376,060 | B2 * | 2/2013 | Orr | A62C 35/68 169/37 |
| 8,382,346 | B2 * | 2/2013 | Schultheis | B60Q 3/76 362/419 |
| 8,502,464 | B2 | 8/2013 | Lakirovich et al. | 315/276 |
| 8,905,583 | B2 * | 12/2014 | Dubord | F21V 29/507 174/653 |
| 9,033,557 | B2 | 5/2015 | Potucek et al. | F21V 21/047 |
| 9,046,247 | B2 | 6/2015 | Potucek et al. | F21V 15/01 |
| 9,100,999 | B2 | 8/2015 | Li | H05B 37/02 |
| 9,299,493 | B2 | 3/2016 | Kuennen et al. | H01F 38/14 |
| 9,502,907 | B2 | 11/2016 | Potucek et al. | H02J 5/005 |
| 9,544,964 | B2 | 1/2017 | Li | H05B 33/0845 |
| 9,590,456 | B2 | 3/2017 | Kuennen et al. | H02J 50/10 |
| 9,835,298 | B2 * | 12/2017 | Doyle | F21L 4/00 |
| 10,329,784 | B1 | 6/2019 | Corwin | G05B 15/02 |
| 10,381,872 | B2 | 8/2019 | Potucek et al. | |
| 2002/0044449 | A1 | 4/2002 | Von Wolske | B60Q 1/00 |
| 2002/0130627 | A1 | 9/2002 | Morgan et al. | 315/291 |
| 2004/0052076 | A1 | 3/2004 | Mueller et al. | F21V 9/00 |
| 2004/0184284 | A1 | 9/2004 | Buelow, II et al. | 362/547 |
| 2005/0002184 | A1 | 1/2005 | Kotovsky | F21S 8/00 |
| 2005/0036305 | A1 * | 2/2005 | Kersey | E04H 4/148 362/149 |
| 2006/0022214 | A1 | 2/2006 | Morgan et al. | 257/99 |
| 2006/0101567 | A1 | 5/2006 | Hutchings | E04H 4/00 |
| 2006/0163374 | A1 * | 7/2006 | Wooten | F21S 8/00 239/18 |
| 2011/0031740 | A1 | 2/2011 | Stone | 285/139.2 |
| 2011/0267834 | A1 | 11/2011 | Potucek et al. | 362/551 |
| 2012/0113654 | A1 * | 5/2012 | Dai | F21V 17/12 362/368 |
| 2013/0098712 | A1 | 4/2013 | Svendsen et al. | 187/381 |
| 2013/0134891 | A1 | 5/2013 | Woytowitz | H05B 37/02 |
| 2013/0182442 | A1 | 7/2013 | Potucek et al. | 362/294 |
| 2013/0249479 | A1 | 9/2013 | Partovi | H02J 7/00 |
| 2014/0092606 | A1 | 4/2014 | Potucek et al. | 362/365 |
| 2014/0203710 | A1 | 7/2014 | Li | 315/129 |
| 2014/0268824 | A1 | 9/2014 | Potucek et al. | 362/366 |
| 2014/0336821 | A1 | 11/2014 | Blaine et al. | 700/275 |
| 2015/0005024 | A1 | 1/2015 | Fudicker | H04W 72/04 |
| 2015/0042223 | A1 | 2/2015 | Harrington | 315/70 |
| 2015/0092416 | A1 * | 4/2015 | Potucek | F21V 23/006 362/267 |
| 2015/0260375 | A1 | 9/2015 | Potucek et al. | F21V 15/01 |
| 2016/0131294 | A1 * | 5/2016 | Lind | F16L 41/14 285/139.2 |
| 2016/0323952 | A1 | 11/2016 | Li | H05B 33/0845 |
| 2017/0073990 | A1 | 3/2017 | Potucek et al. | E04H 4/1654 |
| 2017/0073991 | A1 | 3/2017 | Potucek et al. | E04H 4/1654 |
| 2017/0127403 | A1 | 5/2017 | Sapio et al. | H04W 72/04 |
| 2017/0133882 | A1 | 5/2017 | Kuennen et al. | H02J 50/10 |
| 2017/0167717 | A1 | 6/2017 | Duarte | F21V 31/005 |
| 2017/0212489 | A1 | 7/2017 | Potucek et al. | G05B 19/042 |
| 2017/0292686 | A1 | 10/2017 | Fuller et al. | F21V 21/15 |
| 2017/0299159 | A1 * | 10/2017 | Mjelde | E04H 4/148 |
| 2018/0138745 | A1 | 5/2018 | Maud | H02J 50/10 |
| 2019/0174599 | A1 | 6/2019 | Senas | H05B 33/08 |
| 2019/0334368 | A1 | 10/2019 | Wambugu Ngahu | H02J 7/02 |
| 2019/0390473 | A1 * | 12/2019 | Carter | F21V 33/008 |
| 2021/0301547 | A1 * | 9/2021 | Svendsen | F21V 23/023 |

FOREIGN PATENT DOCUMENTS

| | | | |
|---|---|---|---|
| CN | 108668405 | 10/2018 | H05B 33/08 |
| CN | 109743 816 | 5/2019 | H05B 33/08 |
| EP | 0256655 | 7/1987 | F21V 29/00 |
| FR | 2 998 104 | 5/2016 | H01R 43/26 |
| WO | WO 02/101702 | 12/2002 | G09G 3/22 |
| WO | WO 2016/176653 | 11/2016 | H01F 38/14 |
| WO | WO 2017/086520 | 5/2017 | G08C 23/04 |

OTHER PUBLICATIONS

U.S. Appl. No. 16/952,936, filed Nov. 19, 2020, Sanson.

"Colin" catalog, 2016, ShangHai Colin Semiconductor Lighting Co., Ltd, 35 pgs.

Examination Report issued in Australian Application No. 2020205322 dated Sep. 8, 2020, 7 pgs.

Examination Report issued in Australian application No. 2020205322, dated Nov. 30, 2020, 6 pgs.

Examination Report issued in Australian application No. 2020205322, dated Apr. 15, 2021, 6 pgs.

"LoRa" Wikipedia page, https://en.wikipedia.org/w/index.php?title=LoRa&oldid=905603424 last edited Jul. 10, 2019, 5 pgs.

Extended Search Report issued in EP application No. 20185529.3, dated Dec. 17, 2020, 9 pgs.

"Mod Lite Power Pass Wireless" S.R.Smith, LLC, 2019, 1 pg.

Office Action issued in Canadian Application No. 3,086,364 dated Sep. 2, 2020, 3 pgs.

Office Action issued in U.S. Appl. No. 16/543,092, dated Dec. 4, 2019 (17 pgs).

Office Action issued in U.S. Appl. No. 16/502,748 dated Apr. 16, 2020, 27 pgs.

Office Action issued in U.S. Appl. No. 16/952,936 dated Jan. 6, 2022, 23 pgs.

Notice of Allowance issued in Canadian Application No. 3,086,364 dated Jan. 11, 2021, 1 pg.

Notice of Allowance issued in U.S. Appl. No. 16/543,092 dated Mar. 23, 2020, 8 pgs.

Notice of Allowance issued in U.S. Appl. No. 16/502,748, dated Nov. 12, 2020, 14 pgs.

YouTube video published Sep. 21, 2009, https://www.youtube.com/watch?v=2IAHkm4RFd4, 2 pgs.

* cited by examiner

ADJUSTABLE UNDERWATER LIGHT FIXTURE ADAPTER

FIELD OF THE DISCLOSURE

The present disclosure is generally related to lighting units and more particularly is related to adjustable underwater light fixture adapters.

BACKGROUND OF THE DISCLOSURE

Aquatic lights are commonly used in swimming pools, spas, and other underwater installations to provide lighting to underwater environments. Typical swimming pool lights have a housing which contains a lighting unit, where the housing and lighting unit are positioned within a niche or sidewall cavity formed within the shell of the swimming pool. The swimming pool shell is often formed from reinforced concrete, such as shotcrete or gunite formed over rebar, but some swimming pool shells may be formed from fiberglass, plastics, metals, vinyl, or similar materials. For concrete-formed swimming pools, the niche is often defined by a tube of PVC pipe which is positioned through the wall during installation of the concrete. To power the lighting unit, a wired power supply is connected to an exterior power source and is run along an exterior of the swimming pool shell and through the shell to the niche, where the wired power supply can connect to the lighting unit.

For existing swimming pools, there is a desire by pool owners to upgrade the lighting system in the pool without fully renovating the pool itself. For instance, some existing pools have a simple lighting system which provides white light only and can either be turned on or off, whereas modern pool lighting is formed from LED-based lighting units which can be controlled to provide a large number of colors which are switchable in a variety of ways. Similarly, pool owners desire to have more control on the size, position, and direction of their pool lights.

Thus, a heretofore unaddressed need exists in the industry to address the aforementioned deficiencies and inadequacies.

SUMMARY OF THE DISCLOSURE

Embodiments of the present disclosure provide systems, apparatuses, and related methods for an underwater light fixture adapter. Briefly described, in architecture, one embodiment of the system, among others, can be implemented as follows. A lighting unit has a housing with at least one light positioned within the housing. An adapter has a substantially cylindrical shape with an open interior portion, wherein at least a portion of the housing is positionable within the open interior portion. A connection system is formed between the adapter and the housing of the lighting unit, wherein the connection system secures the housing to the adapter. At least one pivot contact is formed on an exterior surface of the adapter, the at least one pivot contact having a curved surface, wherein the curved surface is contactable to an inner wall of a niche to allow the housing and adapter to pivot.

The present disclosure can also be viewed as providing an adapter apparatus for use with an underwater light fixture. Briefly described, in architecture, one embodiment of the apparatus, among others, can be implemented as follows. An adapter body has a substantially cylindrical shape with an open interior portion. A first portion of the adapter body has at least part of a connection system formed therein. A second portion of the adapter body has at least one pivot contact having a curved surface, wherein the curved surface is contactable to an inner wall of a niche to allow a housing of a light unit to pivot.

The present disclosure can also be viewed as providing an underwater light fixture adapter system for use with a swimming pool. Briefly described, in architecture, one embodiment of the system, among others, can be implemented as follows. A swimming pool has a niche formed in a sidewall thereof. A lighting unit has a housing with at least one light positioned within the housing. An adapter has a substantially cylindrical shape with an open interior portion, wherein at least a portion of the housing is positionable within the open interior portion. A connection system is formed between the adapter and the housing of the lighting unit, wherein the connection system secures the housing to the adapter. At least one pivot contact is formed on an exterior surface of the adapter, the at least one pivot contact having a curved surface. The curved surface contacts an inner wall of the niche to allow the housing and adapter to pivot relative to the niche.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
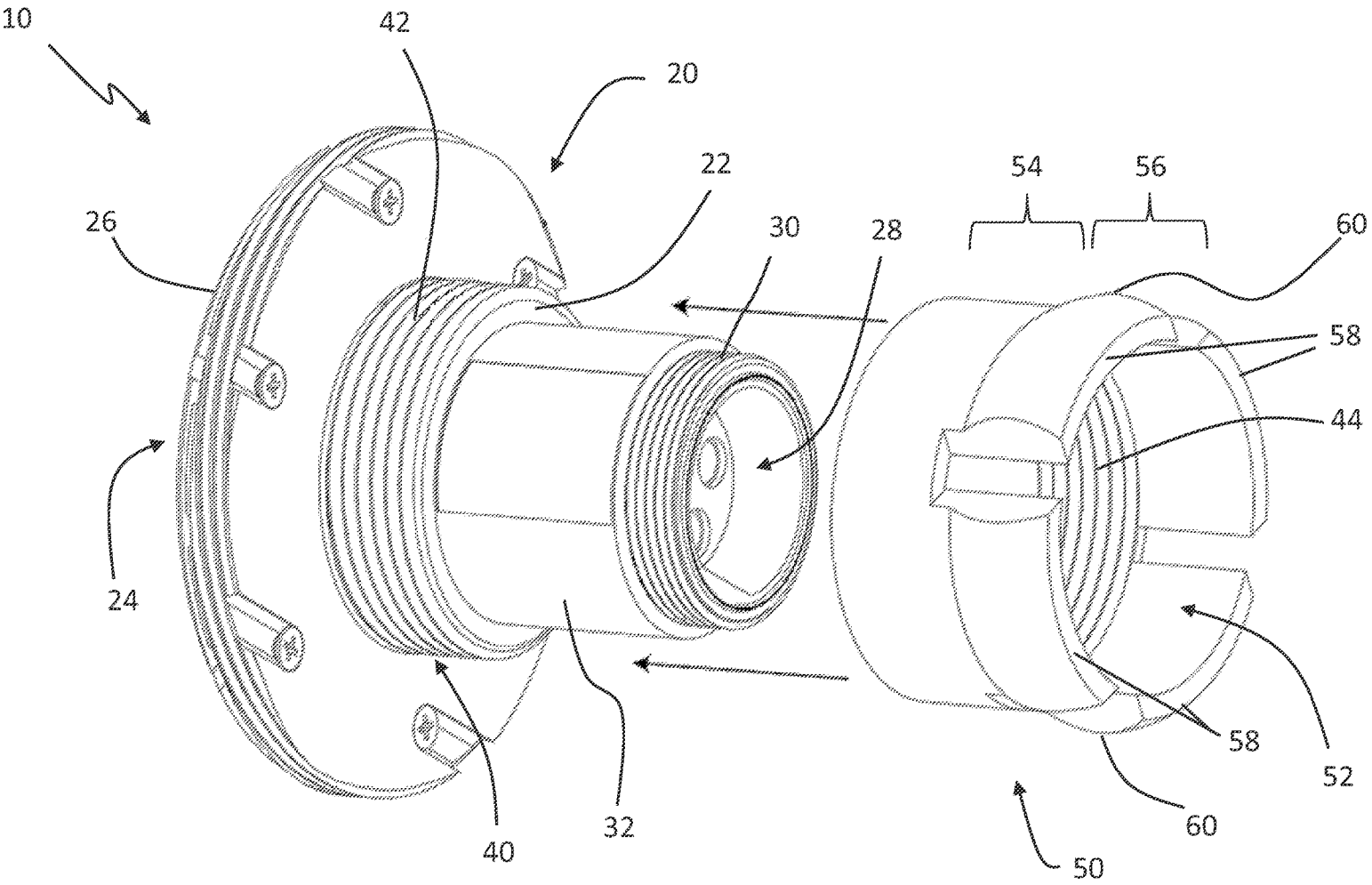
FIG. 1 is a perspective sideview illustration of an underwater light fixture adapter system in a separated configuration, in accordance with a first exemplary embodiment of the present disclosure.
Figure 2:
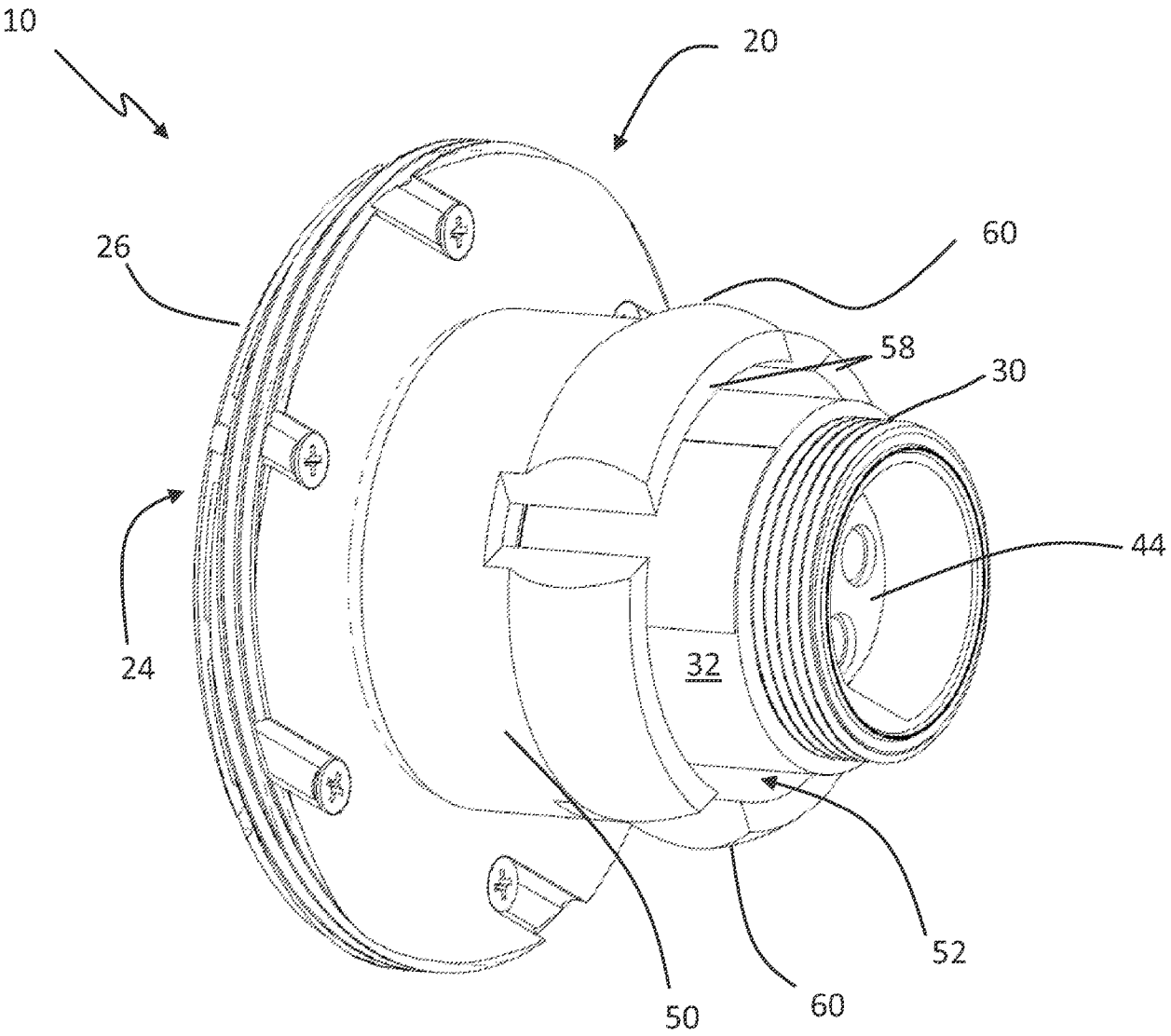
FIG. 2 is a perspective sideview illustration of the underwater light fixture adapter system in a connected configuration, in accordance with the first exemplary embodiment of the present disclosure.

To improve over conventional lights and lighting units used in swimming pools, spas, and similar high-moisture environments, the present disclosure provides an underwater light fixture adapter system and an adapter for use with an underwater light fixture, among other technologies. FIG. 1 is a perspective sideview illustration of the underwater light fixture adapter system 10 in a separated configuration, in accordance with a first exemplary embodiment of the present disclosure. FIG. 2 is a perspective sideview illustration of the underwater light fixture adapter system 10 in a connected configuration, in accordance with the first exemplary embodiment of the present disclosure.

Relative to FIGS. 1-2, the underwater light fixture adapter system 10, which may be referred to as 'system 10', includes a lighting unit 20 having a housing 22 with at least one light 24 positioned within the housing 22. The lighting unit 20 may include various types of lighting systems, including those which utilize light-emitting diodes (LEDs) to provide illumination. In FIG. 1, the lighting unit 20 includes a housing 22, which substantially encloses all components and parts of the lighting unit 20, and a lens plate 26 which is transparent and allows visible light from the light 24 to illuminate the surrounding area in which the lighting unit 20 is positioned. The housing 22 may be, in whole or part, substantially cylindrical in shape, such that the rear part of the lighting unit 20 can be positioned within a niche of a swimming pool, which is often formed from cylindrical PVC pipe.

As shown in FIGS. 1-2, the housing may include a connection port 28 to which the power source and any control wiring may be connected, such as by threading on a wiring cap (not shown) to the annular threaded portion 30 of the housing. The body 32 of the housing 22 may extend from the lens plate 26 to the rear, terminating portion of the lighting unit 20 where the wired connection supplying power to the lighting unit 20 is attachable to the connection port 28.

The adapter 50, as shown in FIGS. 1-2, has a substantially cylindrical shape with an open interior portion 52, which is sized to receive the body 32 of the housing 22 of the lighting unit 20, as shown in FIG. 2. In particular, the open interior portion 52 may have a diameter which is large enough to receive the outer diameter of the body 32, along with the connection port 28 and any wired connections which are engaged with the connection port 28. The adapter 50 may be characterized as having a first portion 54 and a second portion 56, where the second portion 56 has at least one pivot contact 60. In the example as shown in FIGS. 1-2, the first portion 54 of the adapter 50 may be a solid cylindrical structure, whereas the second portion 56 with the one or more pivot contacts 60 may be formed from tabs 58 extending from the solid cylindrical structure about at least part of the circumference of the adapter, where each tab 58 includes a pivot contact 60. Other designs are envisioned with different structures, all of which are considered within the scope of this disclosure.

Along the body 32 of the housing 22 and on or along the adapter 50, one or more parts of a connection system 40 may be formed, positioned, or otherwise located. In one example, the connection system 40 includes a threaded male portion 42 on the body 32 of the housing 22 with a corresponding threaded female portion 44 positioned on the interior sidewall of the first portion 54 of the adapter 50. When the body 32 of the housing 22 is moved into the interior portion 52 of the adapter 50, the threaded male portion 42 and the threaded female portion 44 may contact, at which point the housing 22 may be rotated to thread the body 32 of the housing 22 to the adapter 50. This ensures that the lighting unit 20 is connected to the adapter 50. Other forms of connection systems 40 may also be used, including those without threaded connections. For instance, snap-fit, friction-fit, magnetic, adhesive, or other chemical, mechanical, or electromechanical connections may be used, all of which are considered within the scope of the present disclosure.

As shown, FIG. 1 illustrates the lighting unit 20 and the adapter 50 separated while FIG. 2 illustrates the lighting unit 20 and adapter 50 in a connected position, where the connection system 40 is engaged. Because the connection system 40 allows attachment and detachment between the lighting unit 20 and an adapter 50, a user can attach and detach the two structures as he or she wishes. For instance, a user with an existing pool and conventional light fixture can retrofit that existing light fixture with a new adapter 50 such that the light fixture can be adjustable, or new construction swimming pools can be built with the adapter 50 to ensure that the lighting fixtures are adjustable in orientation or direction of illumination.

Figure 3:
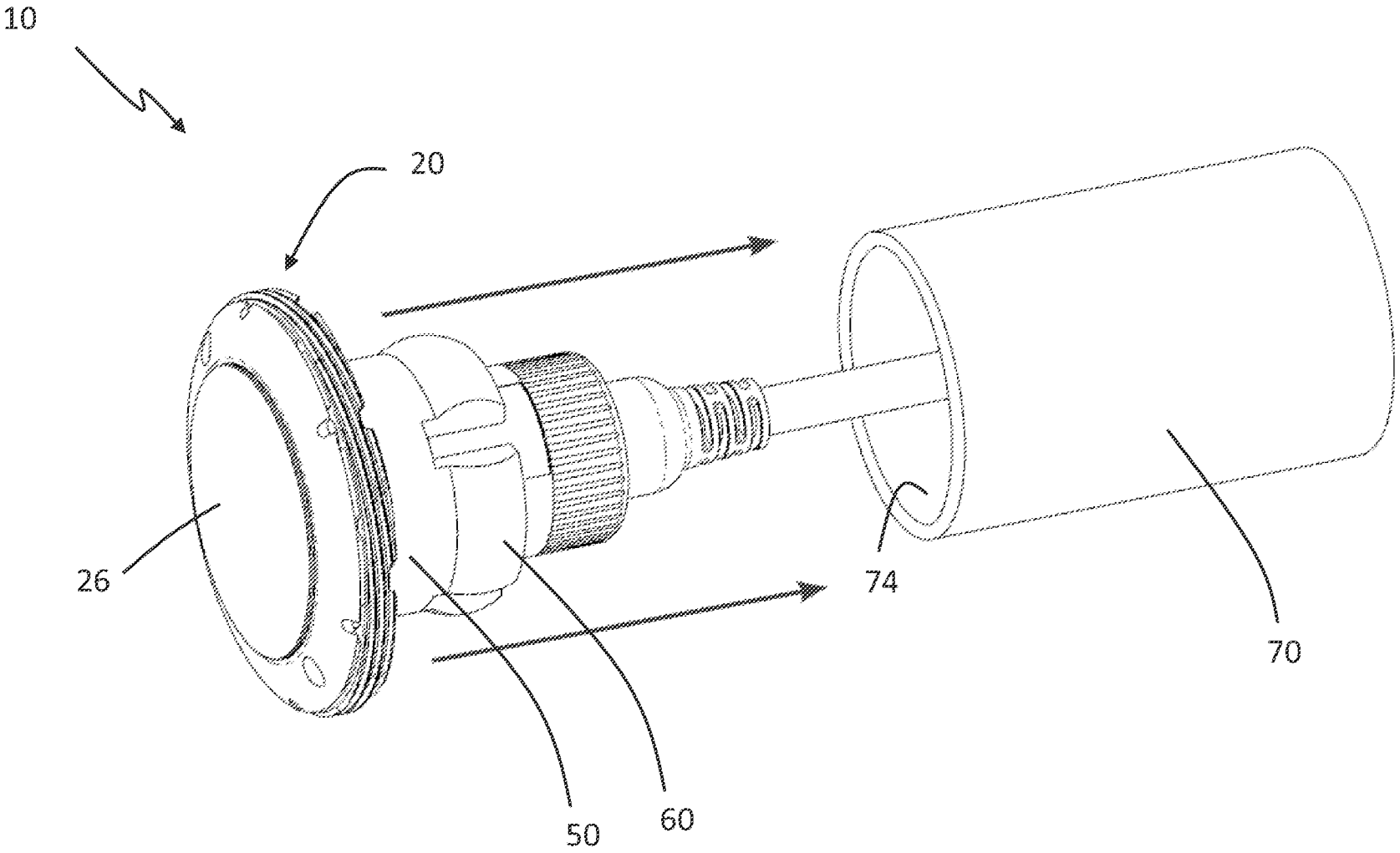
FIG. 3 is a perspective sideview illustration of the underwater light fixture adapter system before insertion into a niche, in accordance with the first exemplary embodiment of the present disclosure.
Figure 4:
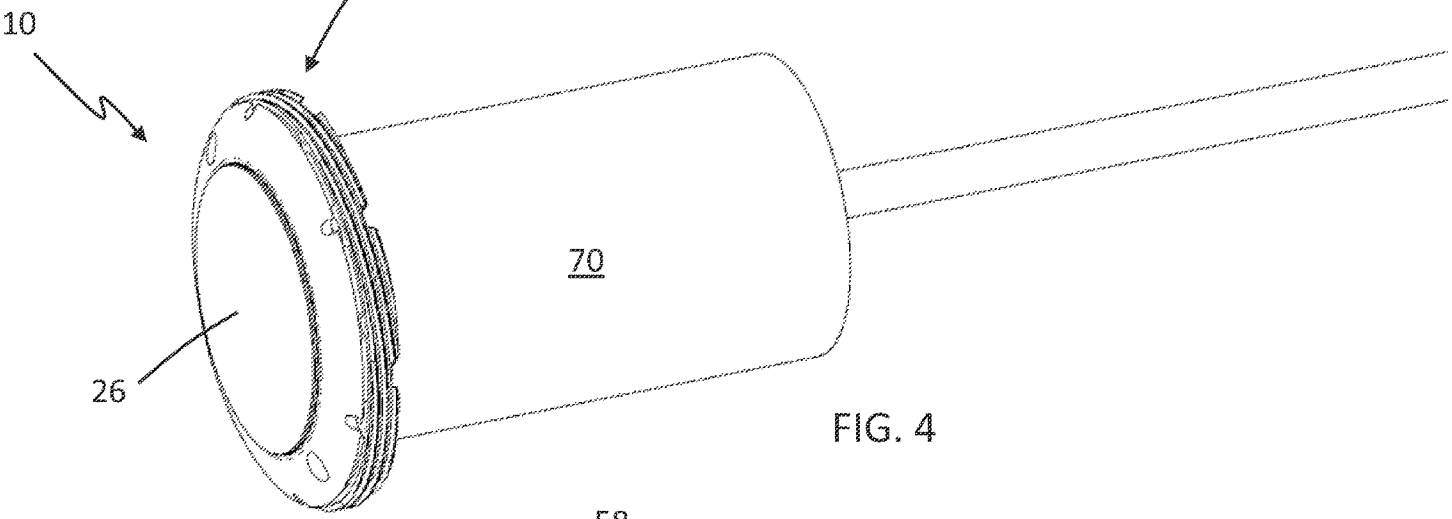
FIG. 4 is a perspective sideview illustration of the underwater light fixture adapter system within a niche, in accordance with the first exemplary embodiment of the present disclosure.
Figure 5:
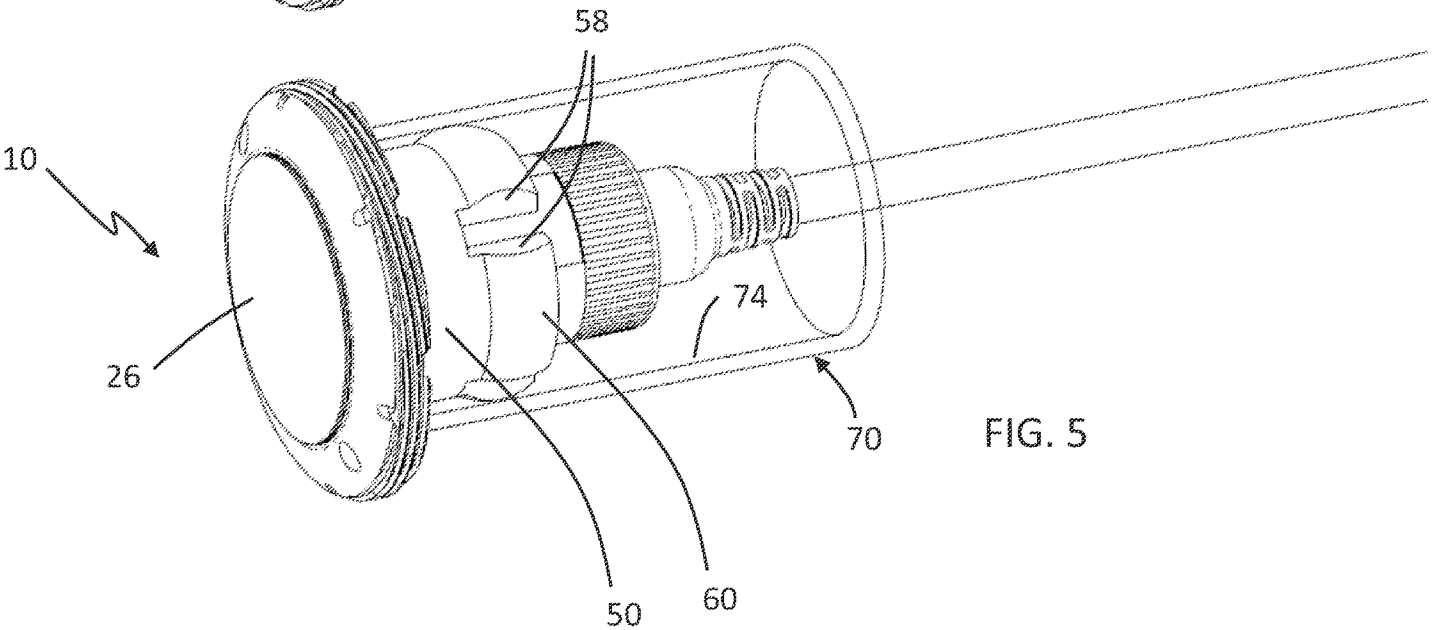
FIG. 5 is a partial cross-sectional illustration of the underwater light fixture adapter system within a niche of FIG. 4, in accordance with the first exemplary embodiment of the present disclosure.
Figure 6A:
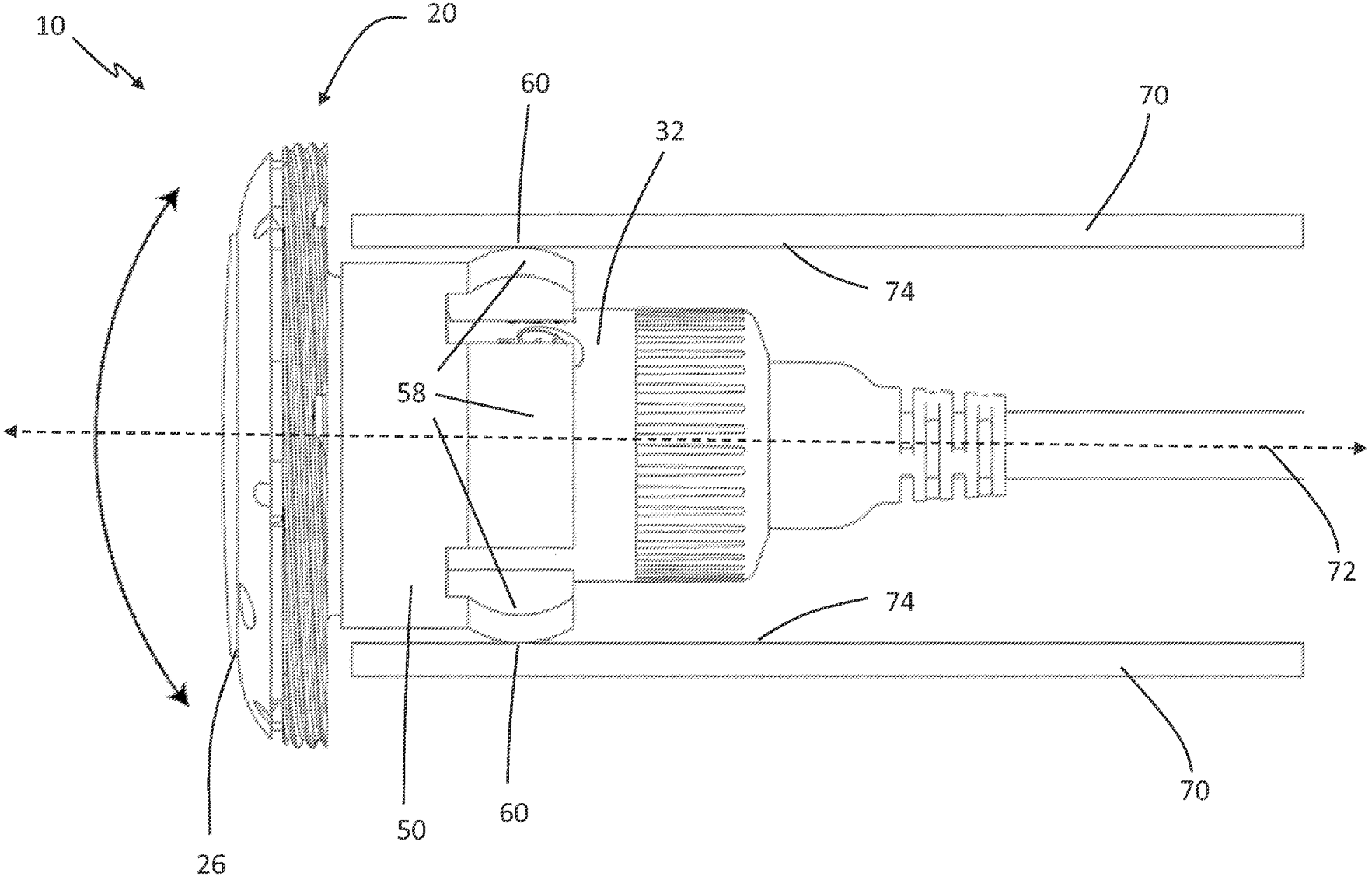
FIGS. 6A-6C are partial cross-sectional illustrations of the underwater light fixture adapter system within a niche of FIGS. 4-5, in accordance with the first exemplary embodiment of the present disclosure.
Figure 6B:
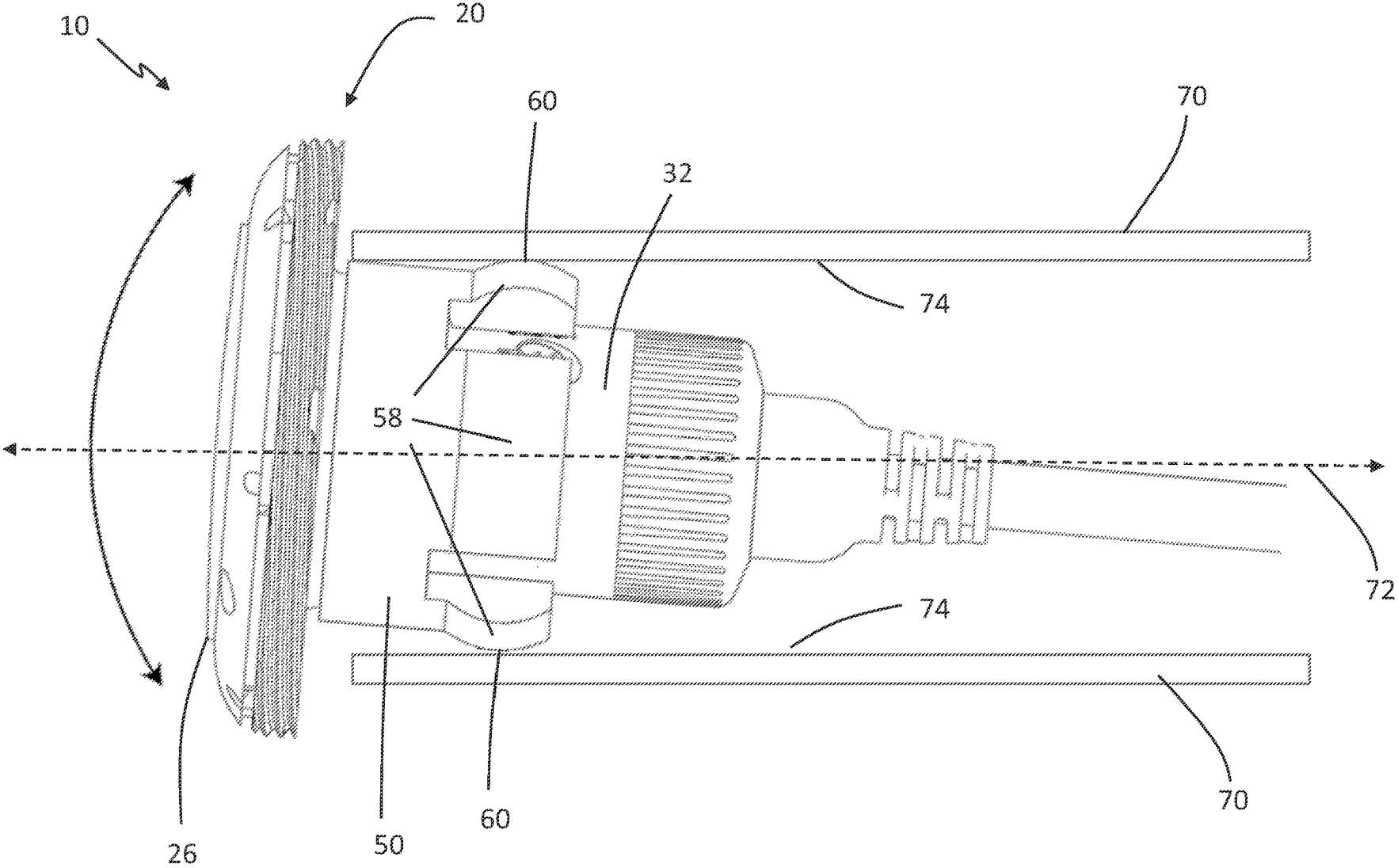
Figure 6C:
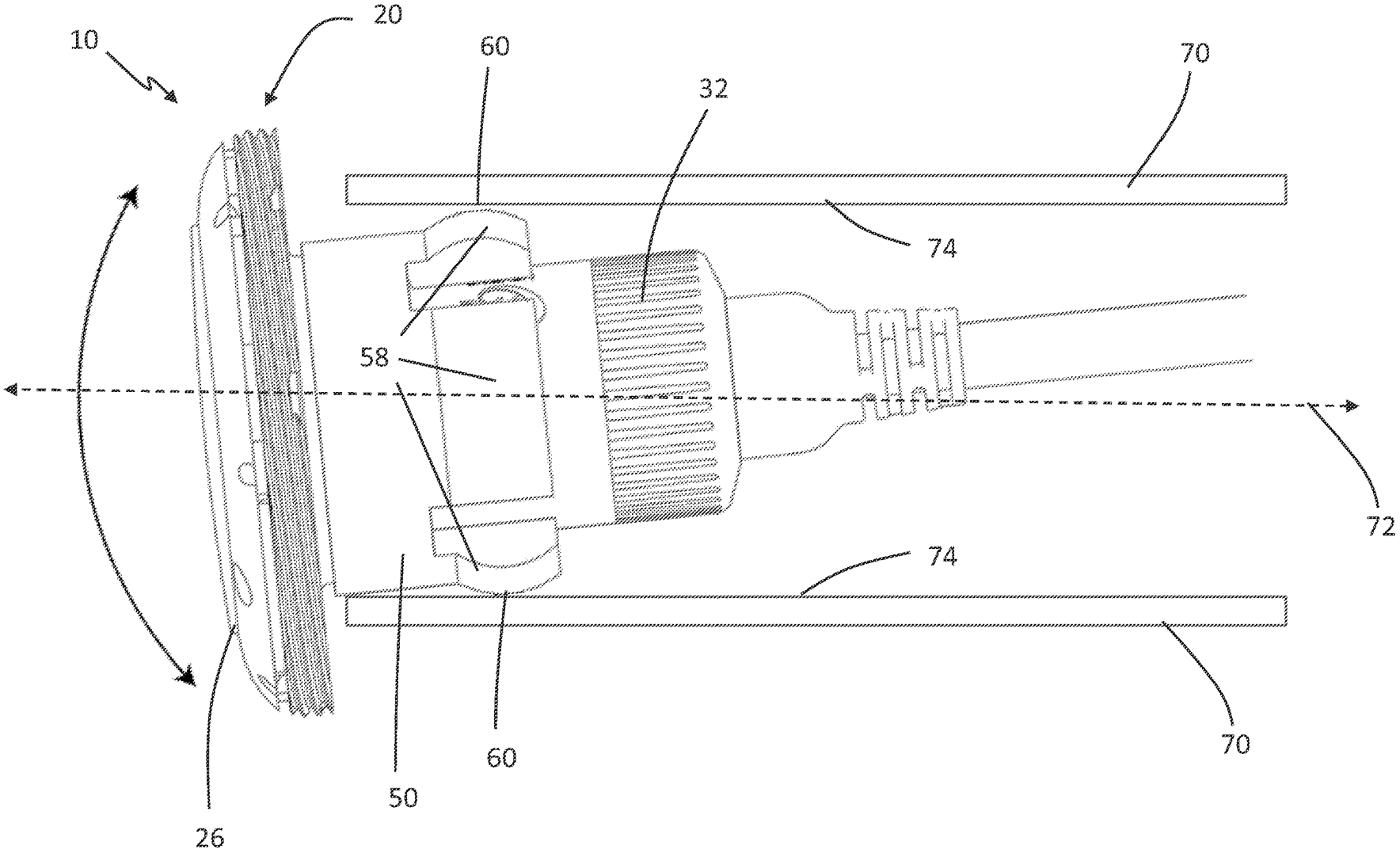

Next, the system 10 is described relative to a swimming pool niche. FIG. 3 is a perspective sideview illustration of the underwater light fixture adapter system before insertion into a niche, FIG. 4 is a perspective sideview illustration of the underwater light fixture adapter system within a niche, and FIG. 5 is a partial cross-sectional illustration of the underwater light fixture adapter system within a niche of FIG. 4, in accordance with the first exemplary embodiment of the present disclosure. Additionally, FIGS. 6A-6C are partial cross-sectional illustrations of the underwater light fixture adapter system within a niche of FIGS. 4-5, in accordance with the first exemplary embodiment of the present disclosure.

With reference to FIGS. 1-6C, the at least one pivot contact 60 on the adapter 50 may allow the lighting unit 20 to be pivoted or adjusted in orientation relative to a swimming pool niche 70. More specifically, the at least one pivot contact 60 may allow for movement of the lighting unit 20 relative to a central axis 72 of the niche 70, such that a central axis of the lighting unit 20 and housing 22 is not parallel with the central axis 72 of the niche 70. For example, as shown in FIG. 6A, the lighting unit 20, housing 22, and adapter 50 are positioned substantially coaxial with the niche 70, whereas in FIGS. 6B-6C, the central axis of the lighting unit 20, the housing 22 and the adapter 50 are not coaxial with the niche 70, such that the lighting unit 20 and adapter 50 have been pivoted within the niche 70 to angle the direction of illuminated light. In one example, the angle of pivot or tilt may be up to 10° in any direction about the central axis 72 of the niche 70. In other examples, the angle of pivot or tilt may be less than or greater than 10°.

As shown in the figures, the pivot contact 60 may be formed on an exterior surface of the adapter 50, where the pivot contact 60 includes a curved surface which is positioned to contact the inner surface 74 of the niche 70. The curved surface of the pivot contact 60 may have a gentle curvature which is continuous, such that contact between the curved surface and the inner surface of the niche are smooth and uninterrupted when the lighting unit 20 is tilted or pivoted relative to a central axis 72 of the niche 70. In other examples, the curved surface may have other shapes, such as non-continuous curvatures which allow for certain types of pivoting motion.

The outer diameter of the second portion 56 of the adapter 50 which has the pivot contacts 60 may be sized or toleranced to fit appropriately with the inner diameter of the niche 70. For example, as shown in FIG. 3, when the lighting unit 20 with adapter 50 is ready to be inserted into the niche 70, the outer diameter of the pivot contacts 60 may be sized the same size or slightly smaller than the inner diameter of the niche 70. When the lighting unit 20 with adapter 50 is fully positioned within the niche 70, as shown in FIGS. 4-5, the curved surfaces of the pivot contacts 60 may be in contact with the inner sidewall 74 of the niche 70. It is noted that the curved surfaces of the pivot contacts 60 may be the outermost portion of the adapter 50, which itself has a larger overall diameter than the body 32 of the housing 22, such that the adapter 50 interfaces between the housing 22 and the niche 70.

As shown in FIG. 5, the pivot contacts 60 may be formed on tabs 58 extending from the solid portion of the adapter 50, such that the tabs 58 are slightly biasable inwards. In this design, when the adapter 50 is introduced to the inner part of the niche 70, the contact between the inner surface 74 of the sidewall of the niche 70 and the curved surface on the pivot contacts 60 may cause the tabs 58 to bias slightly inwards, such that they exert a constant outward force on the surface 74 of the niche 70. This outwards force may be sufficient to provide a fractioned fit between the pivot contacts 60 and the surface 74 of the niche 70, thereby holding the lighting unit 20 in a stationary position and preventing inadvertent movement.

It is noted that various designs may be used for the pivot contacts 60, including positioning them on extending tabs 58 which are biasable inwards. In one example, four such tabs 58 may be used, but any number of extending tabs can also be utilized. Additionally, instead of separate tabs 58, it may be possible to use one continuous section of the adapter 50 which is constructed from a material or materials which allow it to frictionally connect to the niche 70. For example, the use of rubberized materials or a lightweight plastic material which can be manipulated could be used to make contact between the adapter 50 and the niche 70.

It is noted that the contact between the pivot contact 60 and the inner surface 74 of the niche 70 may be along the entirety of the pivot contact surface 60, such as along the entirety (or substantially the entirety) of the circumference of the niche 70, or a portion of the circumference thereof. In one example, the curved surface of the pivot contact is curved in two dimensions, such that one dimension of curvature allows pivoting or tilting movement of the lighting unit 20 within the niche 70, while another dimension of curvature along a width of each tab 58, e.g., in the direction of the circumference of the adapter 50, provides for substantial contact between the curved surface and the niche 70. This substantial contact may mean allowing the lighting unit 20 to be pivoted in substantially any direction of the 360° opening of the niche 70.

Figure 7:
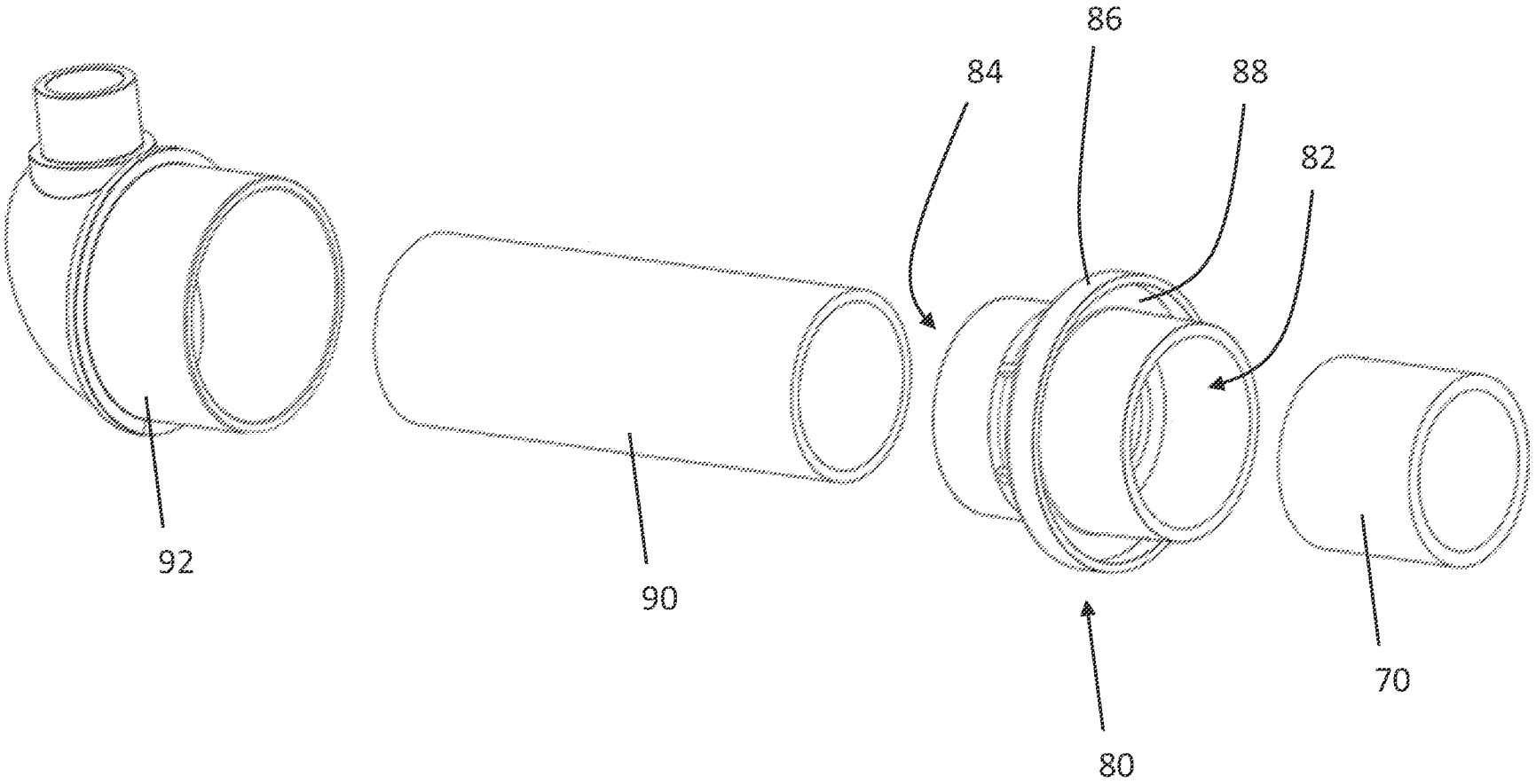
FIG. 7 is an exploded view illustration of swimming pool niche pipework used with underwater light fixture adapter system, in accordance with the first exemplary embodiment of the present disclosure.

The system 10 described relative to FIGS. 1-6C may be used with various pipework within a swimming pool or similar setting. For example, FIG. 7 is an exploded view illustration of swimming pool niche pipework used with underwater light fixture adapter system, in accordance with the first exemplary embodiment of the present disclosure. As shown in FIG. 7, a niche 70 may be formed from a PVC pipe, such as one in a 2-inch size. The niche 70 may be connected to a coupling 80, which interfaces between the niche 70 and a length of pipe 90. The length of pipe 90 may also be formed from PVC, but it may be in a size that differs from that of the niche 70, for instance, 4-inch, 3-inch, 2.5-inch, 1.5-inch, 1-inch, 0.75-inch, or 0.5-inch, among others. As such, the coupling 80 may have an inlet 82 which matches the size of the niche 70 and an outlet 84 which matches the size of the pipe 90. On the other end of the pipe 90 is an RCA coupling 92, which often is formed as an elbow or angled fitting.

When a lighting unit 20 and adapter 50 (FIGS. 1-6C) are positioned within the niche 70, the wired power supply connected to the back of the housing 22 of the lighting unit 20 may be run through the niche pipework and to the power source. For example, the electrical wire or wires may be positioned within the ground surface, likely in a conduit, which is connected to one side of the RCA fitting 92. The wire or wires are then positioned through the pipe 90, through the coupling 80 and to the lighting unit within the niche 70.

Figure 8B:
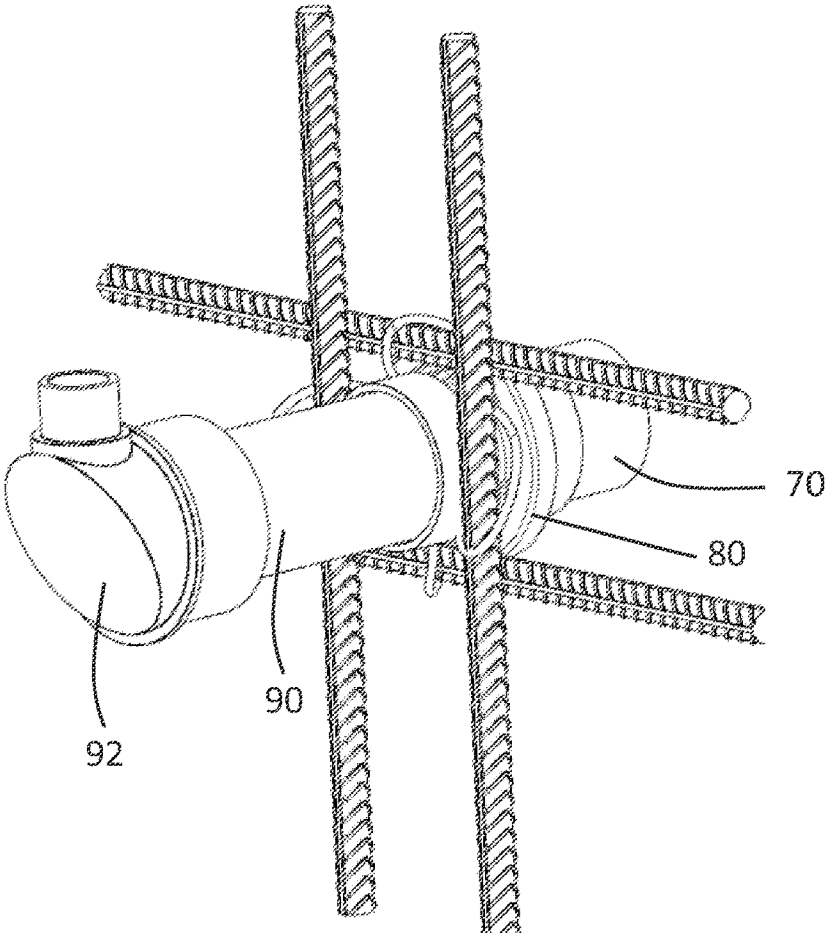
FIGS. 8A-8B are perspective view illustrations of swimming pool niche pipework used with underwater light fixture adapter system, in accordance with the first exemplary embodiment of the present disclosure.
Figure 8A:
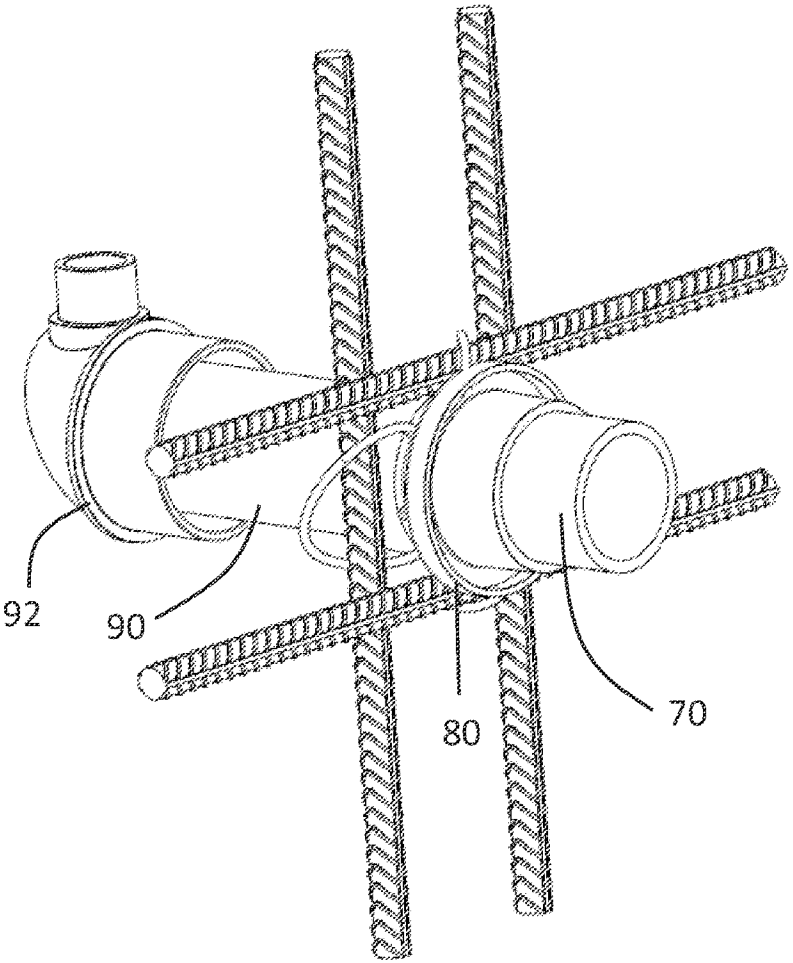

FIGS. 8A-8B are perspective view illustrations of swimming pool niche pipework used with underwater light fixture adapter system, in accordance with the first exemplary embodiment of the present disclosure. As shown in FIGS. 8A-8B, the pipework may be connected together and positioned within a structural framework of a swimming pool, such as the rebar frame used within the sidewalls of concrete pools. FIG. 8A illustrates the niche 70 positioned along the inner sidewall of the pool, while FIG. 8B illustrates the outer sidewall of the pool, where the electrical wire leaves the pipework. During construction of the pool, this pipework may be installed into the structural cage of the pool prior to the installation of the concrete.

It is noted that the coupling 80 may include an annular flange 86 with a recess 88 formed therein, which is positioned within the concrete wall of the pool after construction. In particular, when the concrete is installed to build the pool, the concrete will encapsulate the rebar framework and encapsulate the pipework depicted in FIGS. 8A-8B, with the exception of the end of the niche 70 and the terminating end of the RCA fitting 92. When the concrete is installed, the annular flange 86 is positioned facing the inner sidewall of the pool, such that the recess 88 is facing the interior of the pool. While both the flange 86 and recess 88 are encapsulated in concrete, they still may be useful in preventing the leakage of water from the pool and through the interface between the pipework and the concrete. More specifically, it is noted that PVC pipes often do not bond well to concrete without an adhesive, which is sometimes improperly omitted during installation. As such, water leakage between the pipework and the surrounding concrete can occur, which can lead to structure or operational problems. The annular flange 86 with recess 88 helps prevent this leakage by serving as a barrier to water infiltration, since it is difficult for water to move past the recess 88 of the annular flange 86. This results in a more water-tight lighting interface in the pool.

Figure 9B:
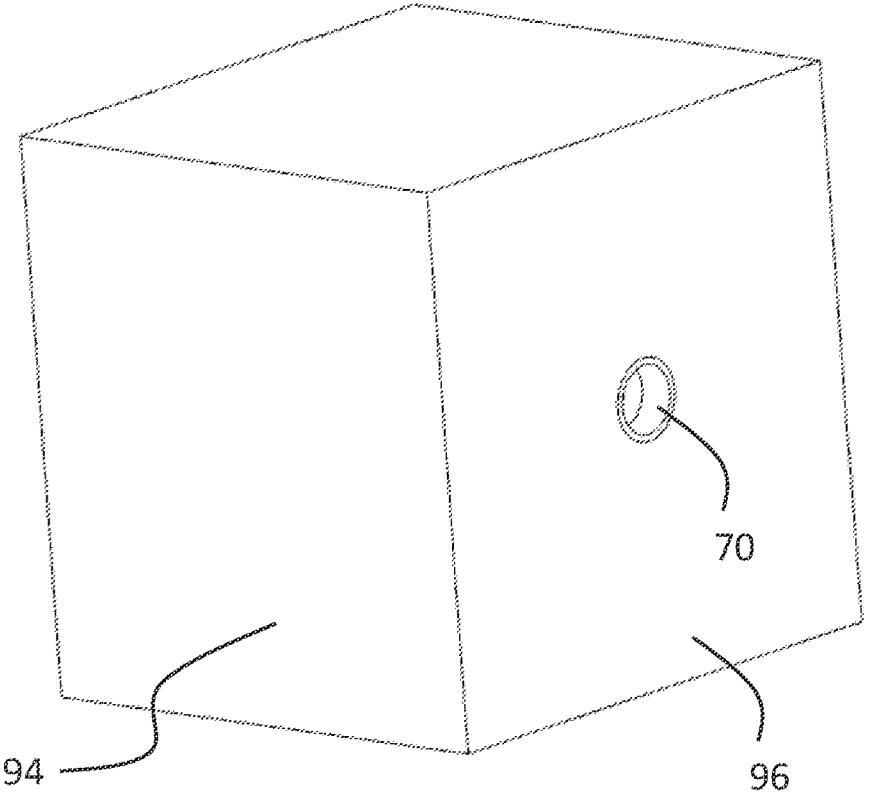
FIGS. 9A-9D are perspective view illustrations of an installation process of the underwater light fixture adapter system, in accordance with the first exemplary embodiment of the present disclosure.
Figure 9A:
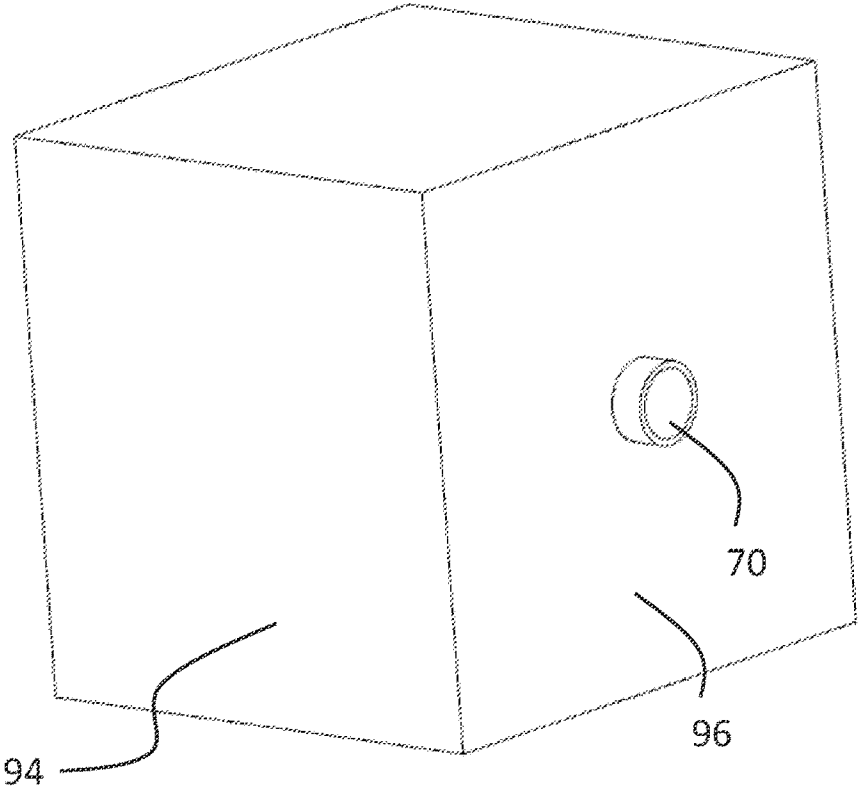
Figure 9D:
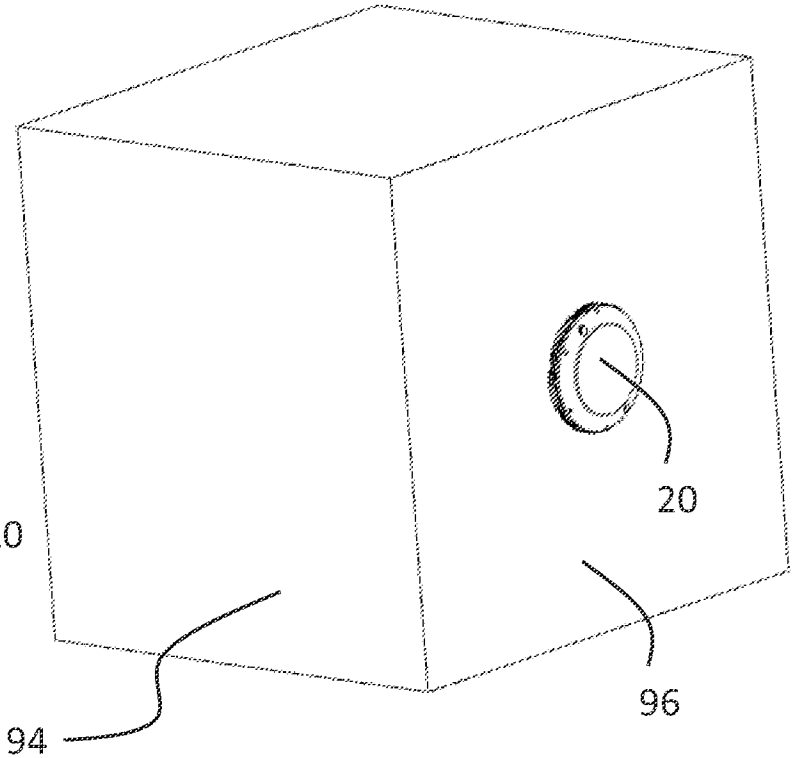
Figure 9C:
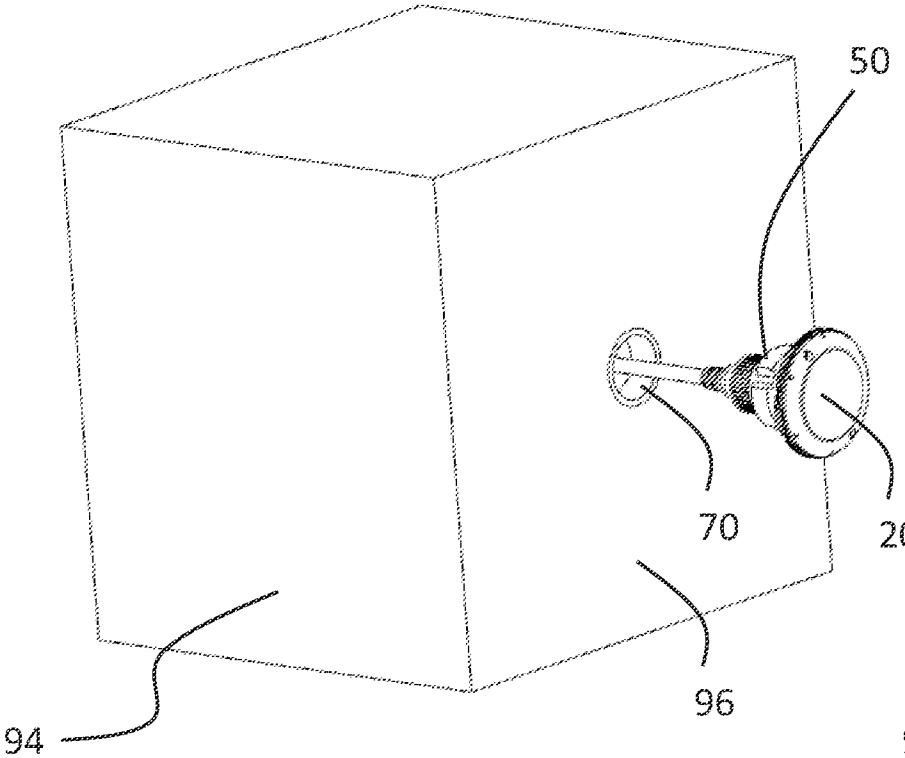

Next, FIGS. 9A-9D are perspective view illustrations of an installation process of the underwater light fixture adapter system, in accordance with the first exemplary embodiment of the present disclosure. In particular, FIG. 9A illustrates a section of a concrete pool wall 94 with encapsulated rebar cage which has the pipework of FIGS. 7-8B installed therein, including the niche 70, the coupling 80, the pipe 90, and the RCA fitting 92. During installation, the niche 70 is left long enough to protrude out the inner sidewall surface 96 of the concrete pool wall 94. In FIG. 9B, the niche 70 is cut to be substantially flush with the inner sidewall surface 96 of the concrete pool wall 94. The lighting unit 20 may then be connected to the adapter 50 as described relative to FIGS. 1-5, and the electrical wire positioned through the pipework is then connected to the rear of the lighting unit 20, as shown in FIG. 9C. The lighting unit 20 with adapter 50 is then inserted into the niche 70, as shown in FIG. 9D, to achieve an installed position. When in this position, a user can adjust the tilt or pivot of the lighting unit 20 relative to the niche 70, thereby directing or angling the illumination direction of the lighting unit 20 to the desired position.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An underwater light fixture adapter system comprising:

a lighting unit having a housing with at least one light positioned within the housing;

an adapter having a substantially cylindrical shape with an open interior portion, wherein at least a portion of the housing is positionable within the open interior portion;

a connection system formed between the adapter and the housing of the lighting unit, wherein the connection system secures the housing to the adapter; and at least one pivot contact formed on an exterior surface of the adapter, the at least one pivot contact having a curved surface contactable to an inner wall of a niche, the niche having a cylindrical shape with a central elongated axis, wherein the inner wall of the niche defines an open interior of the niche, and wherein the inner wall of the niche is a straight inner wall which is straight along a direction of the central elongated axis, wherein the curved surface of the at least one pivot contact is contactable to a portion of the straight inner wall of the niche, thereby allowing the housing and adapter to pivot at an interface between the curved surface of the at least one pivot contact and the straight inner wall of the niche.

2. The system of claim 1, further comprising at least one tab extending from a rear of the adapter, wherein the pivot contact is formed on the at least one tab.

3. The system of claim 2, wherein the at least one tab further comprises four or more tabs extending from the rear of the adapter, wherein a pivot contact is formed on each of the four or more tabs.

4. The system of claim 3, wherein each tab has a curvature in at least two dimensions.

5. The system of claim 2, wherein the at least one tab is biasable inwards.

6. The system of claim 1, wherein the connection system further comprises a threaded male portion on the housing and a corresponding threaded female portion on the adapter.

7. The system of claim 1, wherein the curved surface of the at least one pivot contact is an outmost surface of the adapter.

8. An adapter apparatus for use with an underwater light fixture, the adapter apparatus comprising: an adapter body having a substantially cylindrical shape with an open interior portion; a first portion of the adapter body having at least part of a connection system formed therein; and a second portion of the adapter body having at least one pivot contact having a curved surface, wherein the curved surface is contactable to a straight inner wall of a niche, the straight inner wall being straight along a direction of a central elongate axis of a cylindrically-shaped niche, thereby allowing a housing of a light unit to pivot at an interface between the curved surface of the at least one pivot contact and the straight inner wall of the niche.

9. The adapter apparatus of claim 8, further comprising at least one tab extending from a rear of the adapter body, wherein the pivot contact is formed on the at least one tab.

10. The adapter apparatus of claim 9, wherein the at least one tab further comprises four or more tabs extending from the rear of the adapter body, wherein a pivot contact is formed on each of the four or more tabs.

11. The adapter apparatus of claim 10, wherein each tab has a curvature in at least two dimensions.

12. The adapter apparatus of claim 9, wherein the at least one tab is biasable inwards.

13. The adapter apparatus of claim 8, wherein the connection system further comprises a threaded portion on the first portion of the adapter body.

14. The adapter apparatus of claim 8, wherein the curved surface of the at least one pivot contact is an outmost surface of the adapter.

15. An underwater light fixture adapter system for a swimming pool, the system comprising:

a swimming pool;

a niche formed in a sidewall of the swimming pool, the niche formed from a cylindrical pipe having a central elongated axis, wherein the inner wall of the niche defines an open interior of the niche, and wherein the inner wall of the niche is a straight inner wall which is straight along a direction of the central elongated axis;

a lighting unit having a housing with at least one light positioned within the housing;

an adapter having a substantially cylindrical shape with an open interior portion, wherein at least a portion of the housing is positionable within the open interior portion;

a connection system formed between the adapter and the housing of the lighting unit, wherein the connection system secures the housing to the adapter; and at least one pivot contact formed on an exterior surface of the adapter, the at least one pivot contact having a curved surface, wherein the curved surface contacts the straight inner wall of the niche to allow the housing and adapter to pivot at an interface between the curved surface of the at least one pivot and the straight inner wall of the niche.

16. The system of claim 15, further comprising at least one tab extending from a rear of the adapter, wherein the pivot contact is formed on the at least one tab.

17. The system of claim 16, wherein the at least one tab further comprises four or more tabs extending from the rear of the adapter, wherein a pivot contact is formed on each of the four or more tabs.

18. The system of claim 17, wherein each tab has a curvature in at least two dimensions.

19. The system of claim 16, wherein the at least one tab is biasable inwards.

20. The system of claim 15, wherein the connection system further comprises a threaded male portion on the housing and a corresponding threaded female portion on the adapter.

* * * * *